United States Patent [19]

Florander

[11] Patent Number: 4,586,907

[45] Date of Patent: May 6, 1986

[54] MEANS FOR MOUNTING A THRUSTER PROPELLER UNIT

[75] Inventor: Nils-Åke Florander, Gothenburg, Sweden

[73] Assignee: Gotaverken Arendal AB, Sweden

[21] Appl. No.: 678,563

[22] PCT Filed: Mar. 5, 1984

[86] PCT No.: PCT/SE84/00077

§ 371 Date: Oct. 31, 1984

§ 102(e) Date: Oct. 31, 1984

[87] PCT Pub. No.: WO84/03478

PCT Pub. Date: Sep. 13, 1984

[30] Foreign Application Priority Data

Mar. 4, 1983 [SE] Sweden ..... 8301197

[51] Int. Cl.[4] ..... B63H 1/14

[52] U.S. Cl. ..... 440/49; 440/53; 440/112

[58] Field of Search ..... 440/49, 53, 83, 112; 114/253, 254, 265; 251/1 B; 277/3, 30, 31

[56] References Cited

U.S. PATENT DOCUMENTS

| | | | |
|---|---|---|---|
| 1,771,250 | 7/1930 | Feild | 277/30 X |
| 1,902,360 | 3/1933 | Foster | 277/30 |
| 2,746,709 | 5/1956 | Minor | 251/1 B |
| 4,036,163 | 7/1977 | Pehrsson | 440/112 |
| 4,456,267 | 6/1984 | Bacharach | 277/30 |

*Primary Examiner*—Sherman D. Basinger

*Attorney, Agent, or Firm*—Wegner & Bretschneider

[57] ABSTRACT

The mounting of a thruster propeller unit in the bottom plating of a vessel is facilitated by the use of lifting lines, operable from within the vessel. Each line is made to pass a lock chamber adjacent to an opening in the bottom plating, outside the opening where the thruster propeller is to be fitted. The lock chamber includes a first, rigid tubular member, which is formed as the housing for a slide valve, as well as a second tubular member, which is resilient at least in the transverse direction. The two tubular members define a passage being substantially wider than the diameter of the lifting line. The second tubular member is at its top provided with a sealing sleeve which fits around the line. The locking chamber is connected to a source of compressed air, which makes it possible to maintain a pressure within the chamber balancing the pressure of the surrounding water.

12 Claims, 3 Drawing Figures

MEANS FOR MOUNTING A THRUSTER PROPELLER UNIT

BACKGROUND OF THE INVENTION

Offshore vessel, especially those of the semisubmersible type, are often equipped with thruster propellers, which are rotatable 360° and are used for propulsion, steering as well as for positioning of the vessel. Mounting and dismounting of these thruster propeller units is a difficult and tedious work.

As the propeller units are mounted below the bottom plating of the vessel, the space within the latter, adjacent to the location of mounting, must be separated from the surrounding water. An occasional screening around the opening, where the propeller unit is to be mounted, can easily be arranged, but the lines used for performing the terminating part of the lifting of the unit into the opening has hitherto caused many problems.

Usually there is a vertical tube for each line, which from a hole in the bottom plating, within the vessel, reaches up to or somewhat above the water level. As the decks of the pontoons carrying the semisubmersible vessel during a mounting operation will be located just above water level, the space remaining for the lifting gear will be rather restricted. The required space for the lifting gear must be provided above the deck of the pontoon, in localities needed for other purposes, for instance as bunker or ballast tanks.

SUMMARY OF THE DISCLOSURE

The aim of the present invention is to propose efficient means, which do not require much space, for passing a lifting line through the bottom plating, and which permits some sideward movement of the line.

The invention thus proposes a means for mounting a thruster propeller unit in an opening in the bottom structure of a vessel and comprising at least two lifting lines, operable from inside the vessel, passing out through the bottom plating outside of the opening and being attachable to the thruster propeller unit, when the latter has been brought to a position adjacent to the opening. The invention is characterized in that each lifting line is passed through a lock chamber at the bottom plating, and adjacent to the latter includes a first, rigid tubular member, enclosing a passage substantially wider than the diameter of the lifting line, as well as a second, tubular member being resilient at least transversely to the lifting line, the second member, at its end remote from the bottom plating carrying a packing sealing around the lifting line.

The lock chamber is preferably connected to a source supplying a gaseous fluid at a pressure suited to balance the pressure of the surrounding water. The first tubular member is advantageously formed as the housing for a closure valve.

The second, resilient member preferably includes a bellows-shaped portion, fitted between two flanges, which are held together by means of a number of sidewardly movable, rigid rods. The upper of the two flanges, through which the lifting line passes out from the lock chamber, is preferably provided with a sealing sleeve comprising a number of split rubber washers.

A cowl operable from within the vessel and adapted to close the mounting opening is preferably formed and adapted to permit a watertight fitting of the thruster propeller unit in the portion of the bottom plating surrounding the opening during a preliminary stage of the mounting operation.

BRIEF DESCRIPTION OF THE DRAWINGS

The invention will below be described with reference to the accompanying drawings, in which.

DETAILED DESCRIPTION OF THE PREFERRED EMBODIMENT

Figure 1:
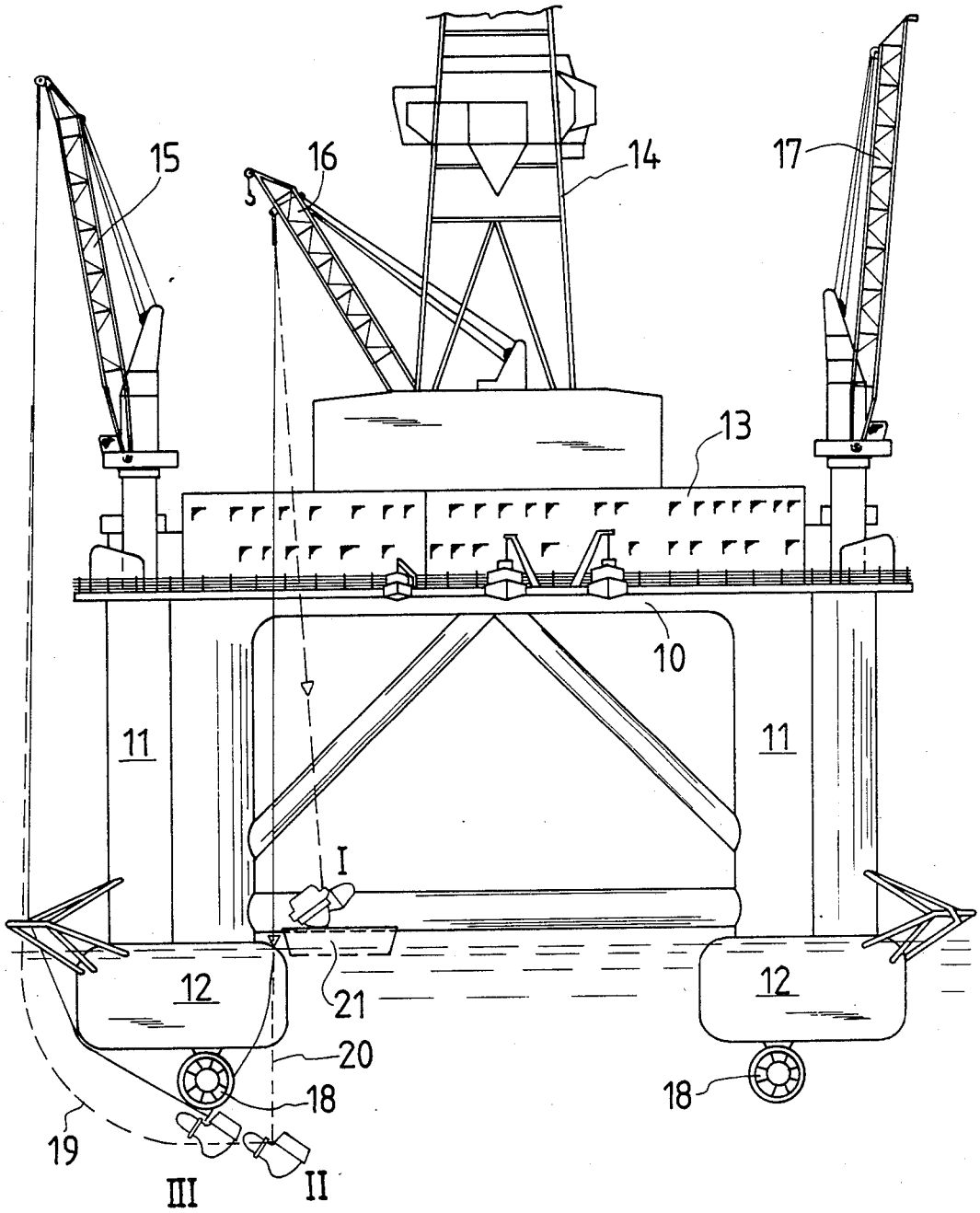
FIG. 1 shows an end view of a semisubmersible offshore vessel during the mounting of a thruster propeller unit.

Thruster propellers may be used with various types of vessels and floating bodies, and the offshore vessel shown in FIG. 1 is one example of a possible use. The figure illustrates one manner of mounting and dismounting the housing of a thruster propeller unit.

The offshore vessel shown comprises a working platform 10, which by means of columns 11 is carried from two pontoons 12. Upon the platform there is a superstructure 13 providing housing for the staff, and including workshop, stores etc. Furthermore there is a derrick 14 and a number of cranes 15, 16, 17.

The vessel is shown in transit position, i.e. the decks of the pontoons 12 are located just above the water level. Each pontoon 12 is provided with a number of thruster propeller units 18, which are located below the bottom plating of the pontoons.

The thruster propeller units are, in the manner better explained in connection with the following figures, mounted in openings in the bottom plating. In the manner indicated in the left part of FIG. 1 a thruster propeller unit 18 may be moved by means of wires 19, 20 from the cranes from a position I upon a barge, to a position II, and then to a position III directly below the intended opening. From position III the unit is lifted into the opening by means of lines operable from within the pontoon.

The attachment of these lines and the releasing of the crane wires will require the assistance of divers. Alternatively the transfer to position III may occur by means of some displacing carrier, which by divers is guided to the desired position below the opening.

The pontoons 12 will in the conventional manner be provided with ballast tanks, as well as with pumping machinery connectable thereto for determining the draft of the pontoons. Furthermore there is an engine room 22 serving each thruster propeller unit.

Figure 2:
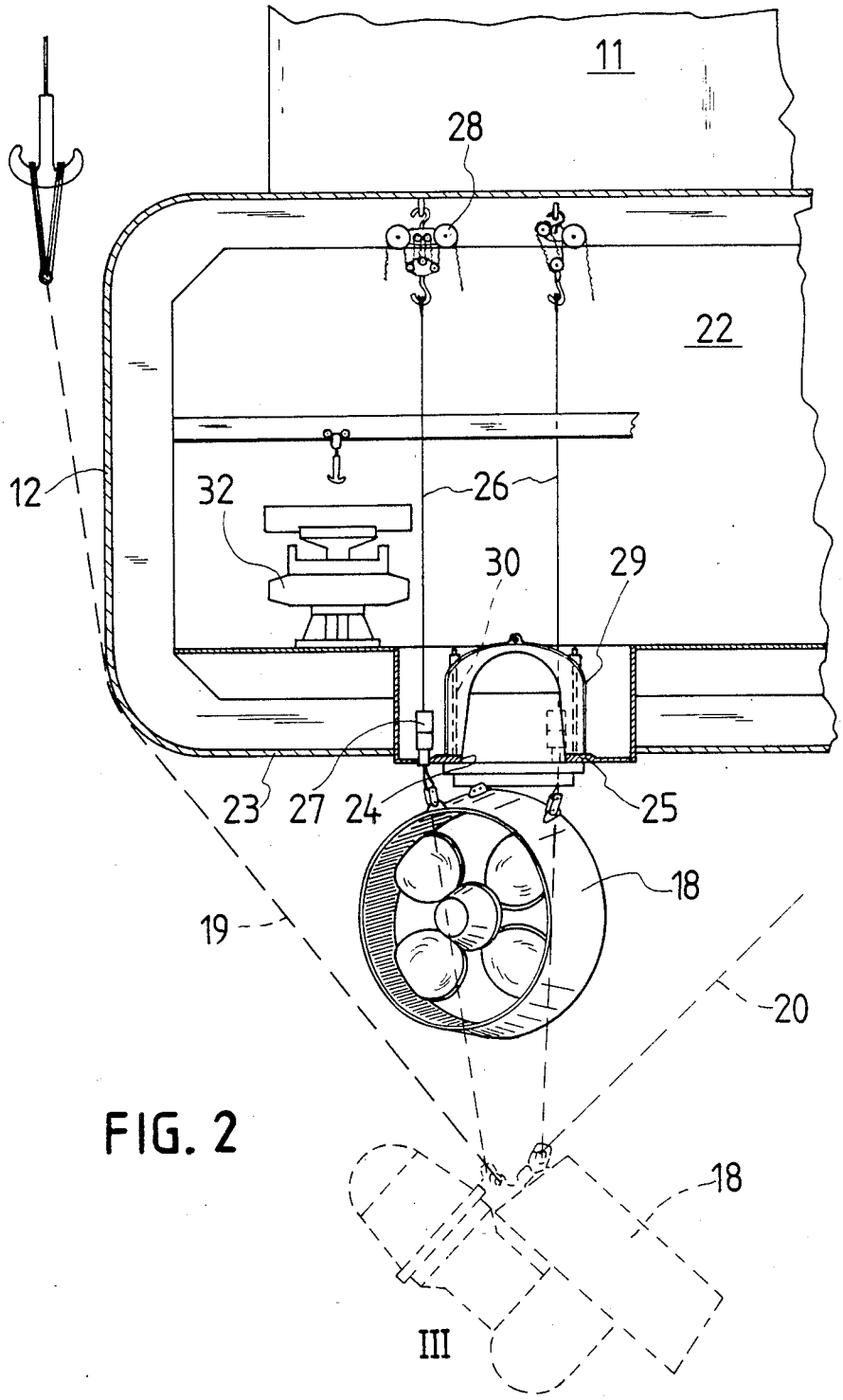
FIG. 2 shows a cross section through a portion of one of the pontoons of the vessel.

In FIG. 2 the bottom plating of a pontoon is denoted by 23, and an opening 24 in the plating is surrounded by a reinforced plate structure 25. A flange at the thruster propeller unit will be bolted watertight to this structure.

The final lifting of a unit is brought about by means of a number of lifting lines 26, preferably three, even if two only are shown in the drawing. These lines are operable from within the engine room 22, and will sealingly pass through the bottom plating by way of lock chambers 27, located outside the opening 24 for the thruster unit.

The lines 26 are connected to lifting gears 28 of arbitrary known type.

FIG. 2 shows, in broken lines, a thruster unit 18 hanging in the crane wires 19 and 20, and in full lines just lifted into the opening 24 by means of the lines 26.

When no unit is mounted in the opening 24 this must be closed-off from the surrounding water.

This can be made by means of a deep cowl 29, which can be fitted to the reinforced structure 25 by means of bolts 30 accessible from the engine room before the pontoon is first launched, or before a fitted unit is removed later on for overhauling.

The cowl 29 must not hamper the mounting and dismounting of the unit 18, and it is so wide, that it can receive the portion of unit extending above its mounting flange.

When the thruster unit 18 has been properly mounted the cowl 29 is removed and a rotating mechanism 32, provisionally stored beside the opening, is fitted. Finally an electric driving motor is mounted upon the rotating mechanism.

Figure 3:
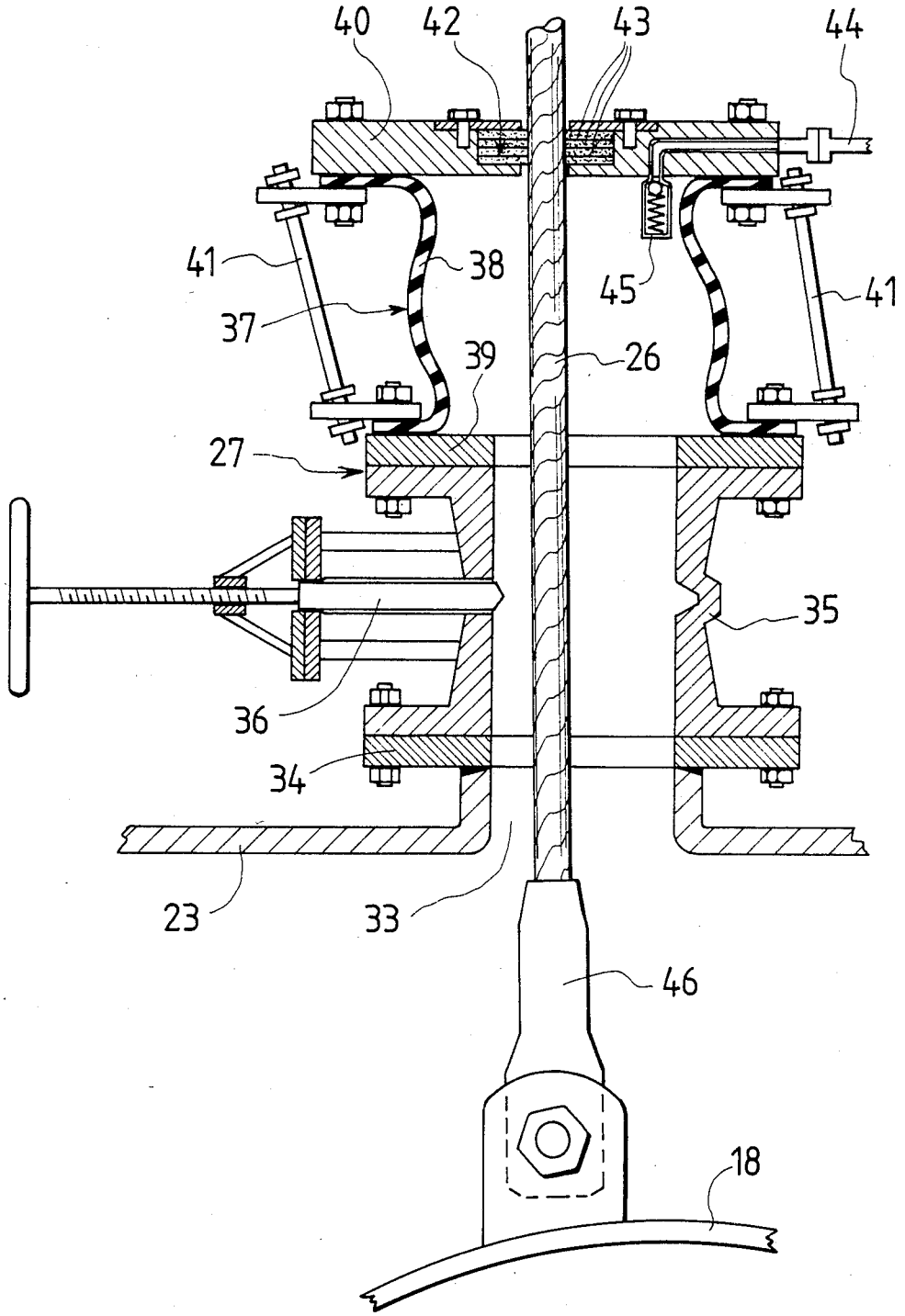
FIG. 3 shows a detail of the lock chamber at the lift line.

FIG. 3 shows, more in detail, a lock chamber 27 permitting the passage of a lifting line 26.

An opening 33 in the bottom plating outside the big opening 24 for the thruster unit is surrounded by a collar having a mounting flange 34.

The lock chamber 27 comprises a first, rigid tubular member 35, which is formed as a housing for a slide valve member 36 and is provided with flanges for mounting at the flange 34 and for carrying a second, resilient tubular member 37.

The rigid tubular member 35 and the opening 33 enclose a passage, which has a considerable cross sectional area compared with the diameter of the lifting line 26, so a terminal fitting 46 at the line can pass.

The resilient member 37 comprises a bellows-shaped portion 38, made for instance of rubber, which permits movements in the transverse direction, and is mounted between two flanges 39, 40. These are interconnected by rigid rods 41, which are mounted so as to follow the transverse movements of the bellows.

The upper flange 40 is provided with an opening, through which the line 26 passes. A sealing sleeve 42 is fitted in this opening, and houses a number of rubber washers 43. These are split radially so as to permit an easy mounting around the line 26, so an efficient sealing is obtained also along the border zones between the individual strand cores.

In order to prevent the entrance of water into the engine room, the lock chamber is connected to a source 44 supplying a gaseous fluid, preferably compressed air, and having a pressure suitable to balance the pressure of the surrounding water. The lock chamber can in this manner be maintained substantially free from water.

In the supply conduit there is a non-return valve 45, which prevents water entering the supply conduit in case of failure of the supply source.

The embodiment above described and shown in the drawings is an example only of the invention, and the details thereof may be varied in many ways within the scope of the appended claims. The means for mounting may be used with various kinds of vessels, and it is evident, that the dismounting of a thruster unit will occur in reverse order, compared to what has been described.

The second resilient member may be shaped in many ways and for instance be composed of a number of annular bellows.

I claim:

1. Means for mounting a thruster propeller unit in an opening in the bottom structure of a vessel and comprising at least two lifting lines, passing out through the bottom plating outside of the opening and being attachable to the thruster propeller unit, when the latter has been brought to a position adjacent to the opening, characterized in that each lifting line is passed through a number of lock chambers mounted at the bottom plating, each permitting the passage of a lifting line and adjacent to the bottom plating including a first, rigid tubular member, enclosing a passage substantially wider that the diameter of the lifting line, and a second, tubular member which is resilient at least transversely to the lifting line, said second member, at its end remote from the bottom plating, supporting a packing sealing around the associated lifting line, and hoisting means within the vessel for operating said lines.

2. A means according to claim 1, characterized in that the lock chamber is connected to a source supplying a gaseous fluid at a pressure suited to maintain the lock chamber substantially free from the water surrounding the vessel.

3. A means according to claim 2, characterized in that the first rigid tubular member (35) is formed as the housing for a closure valve (36).

4. A means according to claim 1, characterized in that the first rigid tubular member (35) is formed as the housing for a closure valve (36).

5. Means for mounting a thruster unit in an opening in the bottom structure of a vessel and comprising at least two lifting lines, operable from inside the vessel, passing out through the bottom plating outside of the opening and being attachable to the thruster propeller unit, when the latter has been brought to a position adjacent to the opening, characterized in that each lifting line is passed through a lock chamber at the bottom plating, and adjacent to the latter includes a first, rigid tubular member, enclosing a passage substantially wider than the diameter of the lifting line, as well as a second, tubular member being resilient at least transversely to the lifting line and including a bellows-shaped portion, fitted between two flanges, which are held together by means of a number of sidewardly movable, rigid rods, the second tubular member, at its end remote from the bottom plating carrying a packing sealing around the lifting line.

6. A means according to claim 5, characterized in that the upper of the two flanges (40), through which the lifting line (26) passes out from the lock chamber (27), is provided with a sealing sleeve (42) comprising a number of split rubber washers (43).

7. A means according to claim 5, characterized in that the lock chamber is connected to a source supplying a gaseous fluid at a pressure suited to balance the pressure of the surrounding water.

8. A means according to claim 7, characterized in that the upper of the two flanges (40), through which the lifting line (26) passes out from the lock chamber (27), is provided with a sealing sleeve (42) comprising a number of split rubber washers (43).

9. A means according to claim 7, characterized in that the first rigid tubular member is formed as the housing for a closure valve.

10. A means according to claim 9, characterized in that the upper of the two flanges (40), through which the lifting line (26) passes out from the lock chamber (27), is provided with a sealing sleeve (42) comprising a number of split rubber washers (43).

11. A means according to claim 5, characterized in that the first rigid tubular member is formed as the housing for a closure valve.

12. A means according to claim 11, characterized in that the upper of the two flanges (40), through which the lifting line (26) passes out from the lock chamber (27), is provided with a sealing sleeve (42) comprising a number of split rubber washers (43).

* * * * *